United States Patent [19]

Howard, Jr.

[11] 4,302,273

[45] Nov. 24, 1981

[54] ETCHING TANK IN WHICH THE SOLUTION CIRCULATES BY CONVECTION

[75] Inventor: Thomas B. Howard, Jr., Mountaintop, Pa.

[73] Assignee: RCA Corporation, New York, N.Y.

[21] Appl. No.: 156,889

[22] Filed: Jun. 4, 1980

[51] Int. Cl.[3] ..... C23F 1/02

[52] U.S. Cl. ..... 156/345; 134/35; 134/106; 156/637

[58] Field of Search ..... 156/345, 637; 134/106, 134/35, 34, 37; 366/144; 60/641 R

[56] References Cited

U.S. PATENT DOCUMENTS

| | | | |
|---|---|---|---|
| 1,829,717 | 10/1931 | Wegner | 134/36 |
| 2,289,890 | 7/1942 | Walter | 134/35 |
| 2,532,457 | 12/1950 | Morgan et al. | 134/34 |
| 3,234,047 | 2/1966 | Olson | 134/35 |
| 3,964,957 | 6/1976 | Walsh | 156/637 |

FOREIGN PATENT DOCUMENTS

| | | | |
|---|---|---|---|
| 424921 | 10/1974 | U.S.S.R. | 156/345 |

*Primary Examiner*—Jerome W. Massie

*Attorney, Agent, or Firm*—Birgit E. Morris; Donald S. Cohen; Robert P. Seitter

[57] ABSTRACT

Direct, but guided, natural convection circulates the treatment solution in a treatment tank during an exothermic reaction because the exothermic-reaction zone is horizontally isolated from a heat transfer or solution temperature adjustment zone. A vertically extending partition system in the middle portion (top-to-bottom) of the tank prevents the solution from flowing direclty between the exothermic-reaction zone and the heat transfer zone thereby limiting solution flow between these zones to the portions of the tank above and below the flow obstructing part of the partition system. This induces macroconvective circulation of the solution within the tank and obviates the need for mechanical stirring during material treatment.

6 Claims, 3 Drawing Figures

ETCHING TANK IN WHICH THE SOLUTION CIRCULATES BY CONVECTION

BACKGROUND OF THE INVENTION

1. Field of the Invention

The invention relates to the field of tank systems for etching semiconductor parts and more particularly to such systems having provision for circulating the treatment solutions and for adjusting the temperature of the treatment solutions.

2. Prior Art

The semiconductor industry uses etching solutions for cleaning wafers, removing unwanted layers from wafers, stress relief of wafers and stock removal from wafers. Stock removal may be uniform or may be nonuniform in a pattern determined by previous processing. These etching solutions are often referred to by reference to their intended purpose. These solutions react exothermically with a material to be removed from the wafers. The rate of material removal in most etching processes is strongly dependent on solution composition, concentration and temperature. Thus, composition nonuniformity and temperature variations make wafer-to-wafer and lot-to-lot process control extremely difficult. This is especially true where only part of the thickness of a layer is to be removed.

In many etching processes the etching solution must be circulated within the tank in order to assure compositional uniformity and temperature stability by enabling a solution cooling system to remove the heat produced by the exothermic reaction. Mere placement of cooling coils within a prior art unobstructed or non-compartmentalized treatment tank does not produce the required degree of temperature stability and composition uniformity.

Mechanical stirring of the solution is complicated because the corrosiveness of the etching solutions severely limits materials which can be used in such equipment. In addition, mechanical stirring can produce nonuniform circulation and often leaves localized eddies and backwaters where little circulation or mixing occurs. Prior art circulation systems intended to induce uniform solution temperature and composition have used pumps, propellers, air bubblers and such for stirring the solution and inducing it to flow past cooling coils. In a further attempt to obtain uniform, repeatable processing results some prior art systems also revolve either the wafer rack containing the wafers or the wafers within the wafer rack.

U.S. Pat. No. 3,964,957 to Walsh discloses a treatment solution circulation system which uses an air bubbler as a pump. The tank for this system has a complicated, convoluted structure in order to prevent the air bubbles from reaching the wafers and producing bubble tracks thereon.

Bubble tracks are areas of a wafer which are treated to a different degree (usually a lesser degree) than the rest of the wafer as a result of bubbles thereon during at least part of the treatment period. Such bubbles change the degree of treatment by preventing solution contact with the surface of the wafer or by preventing that portion of the solution in contact with the wafer surface from having its active ingredients replenished as they are consumed by chemical reactions. These bubbles sometimes remain stationary on the wafer, but can also migrate up the vertical surface of a vertically oriented wafer. Migrating bubbles change the degree of treatment along their entire path, thus the term bubble tracks.

Prior art systems present extreme maintenance problems which can cause downtime. They also consume energy and involve substantial capital, running and maintenance costs. Downtime for equipment repairs is usually very costly because of interrupted product flow and the semiconductor industry is extremely cost conscious. Consequently, any reduction in maintenance downtime, energy consumption and capital, running and maintenance costs is extremely desirable.

The semiconductor industry has been trying to simultaneously increase process repeatability and reliability while reducing complexity and cost. Each of these prior art systems partially sacrifices one or more of these objectives in an attempt to meet the others.

SUMMARY OF THE INVENTION

The intention of this invention is to maximize etching repeatability and reliability while minimizing etching costs, whether these costs be capital for equipment, periodic for solution replenishment or replacement or parts and labor for routine maintenance or system repair. This invention uses a tank structure which induces circulation of the etching solution during etching without any need for mechanical stirring. This tank has treatment and heat transfer zones which are isolated horizontally from each other by vertically extending horizontal-flow-obstructing partitions or baffles. Flow of the treatment solution between the treatment and heat transfer zones is limited to the parts of the tank above the tops of and below the bottoms of the flow obstructing portions of the partitions.

Heat transfer coils in the heat transfer zone are used to add heat to or remove heat from the treatment solution. The amount of heat transfer fluid flowing through the coils or its temperature and thus the degree of temperature adjustment may be controlled in response to a temperature sensor disposed within the treatment solution.

The addition of heat to the treatment solution via the exothermic reaction taking place in the treatment zone and the removal of heat in the heat transfer zone cause the treatment solution to circulate through the tank in response to natural convective effects which cause the solution to flow up through the treatment zone, over the tops of the partitions, down through the heat transfer zone and under the bottom of the partitions and back to the treatment zone in a macroconvective manner.

DETAILED DESCRIPTION OF THE PREFERRED EMBODIMENT

Figure 1:
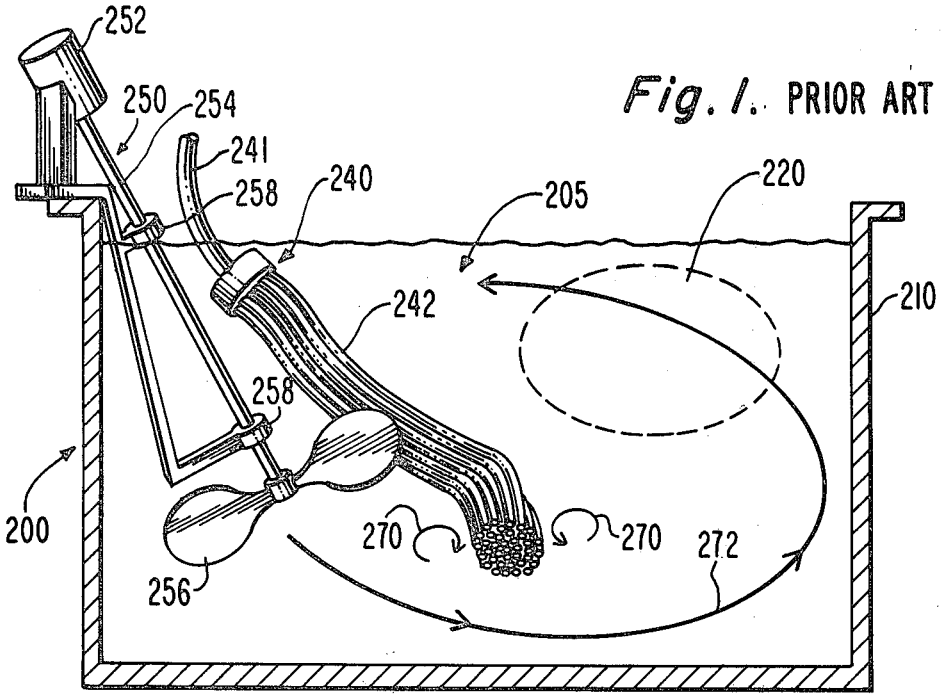
Fig. 1. PRIOR ART
FIG. 1 is an illustration of one type of prior art non-compartmentalized treatment tank employing a propeller for circulation and mixing of the solution.

A PRIOR ART non-compartmentalized tank system illustrated in FIG. 1 comprises a tank 210 equipped with a cooling system 240 and a mechanical stirring system 250. Cooling system 240 comprises a bundle of cooling tubes 242 disposed within the treatment solution within the tank. The tubes 242 are connected to a source of cooling water by a pipe 241. Stirring system 250 comprises a propeller 256 submerged in the treatment solution, a shaft 254 on which the propeller is mounted and a motor 252 which drives the shaft. Shaft 254 is supported by bearings 258.

The tank 210 comprises a single large chamber containing the treatment solution 205, a treatment zone 220, the cooling coils 242 and propeller 256. Wafers to be treated are immersed within the treatment zone 220.

If the stirring system 250 is not activated, then the primary cooling mechanism within the tank is localized convection (which will be called microconvection) in the vicinity of the cooling tubes 242 as indicated by the arrows 270. The treatment solution which is heated by the exothermic reaction within the treatment zone 220 tends to rise to the top of the tank while the solution cooled by the cooling coils tends to sink to the bottom of the tank. This causes stratification of the treatment solution in accordance with its temperature which can in turn induce compositional stratification. Some cooling of the heated solution results from conduction and the spreading of microconvection. However, this does not eliminate stratification.

When stirring system 250 is activated, the propeller 256 produces a current 272 within the tank. The current 272 improves the circulation of the treatment solution, thereby improving solution composition and temperature uniformity.

However, eddies and backwaters can still exist where little or no circulation occurs. In addition, stirring system 250 consumes energy and presents reliability problems because of the presence of moving parts, a problem which is increased by the fact that some of the moving parts are within the corrosive treatment solution.

PRESENT INVENTION

In accordance with the present invention, substantially uniform etching solution circulation, composition and temperature are achieved without mechanical stirring during wafer processing. For purposes of this specification mechanical stirring is defined as the use of externally supplied mechanical motion to induce solution circulation or movement and includes, but is not limited to, gas bubblers, pumps, propellers and such.

Figure 2:
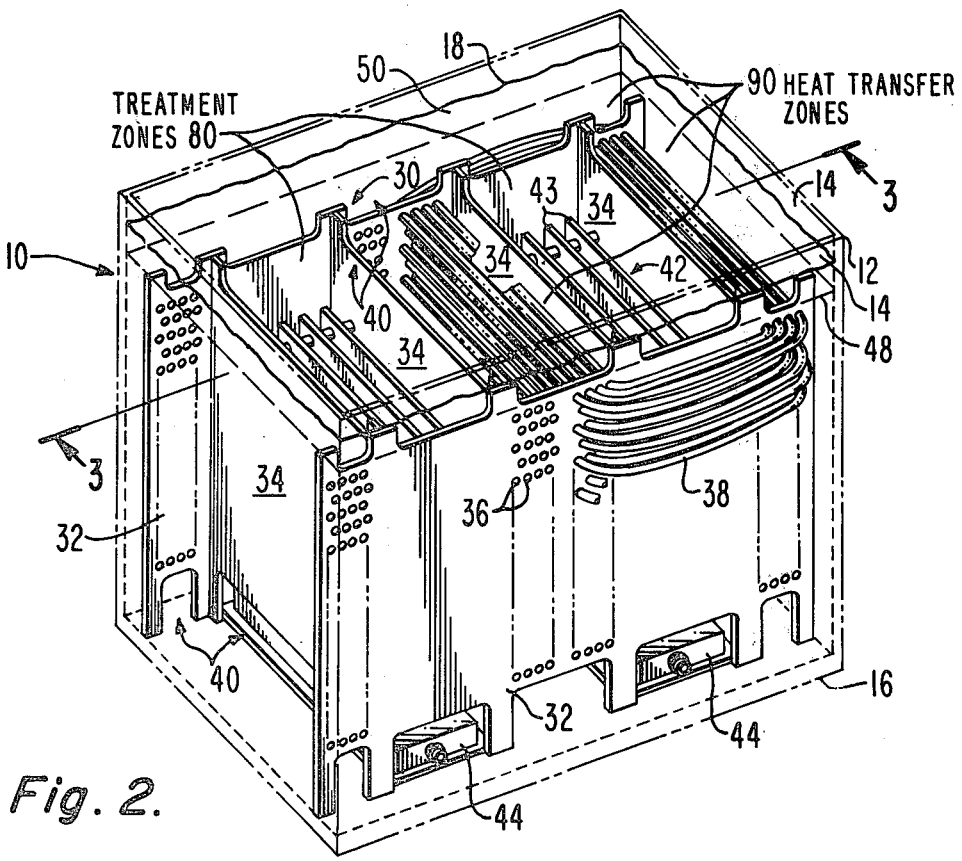
FIG. 2 is a perspective view of an etching tank in accordance with this invention having two treatment zones.

A preferred tank system 10 in accordance with this invention is illustrated in a perspective view in FIG. 2 in which the tank 12 is shown as though it were transparent in order to reveal the detail of the internal structure. The tank 12 has walls 14 and a bottom 16. It contains a treatment solution 50 which should extend at least to the solution line 18 near the top of the tank. A tank partitioning or compartmentalizing means 30 comprised of longitudinal walls 32 and transverse walls 34 rests on the bottom of the tank and divides the tank into horizontally separated treatment zones 80 and heat transfer zones 90. Longitudinal walls 32 have a plurality of holes 36 therein through which heat transfer tubes 38 are threaded. The holes 36 are located in portions of the walls 32 which are within heat transfer zones 90 of the tank. Both the transverse walls 34 and the portions of the longitudinal walls 32 which separate the treatment zones 80 from the heat transfer zones 90 are solid or at least substantially impervious to the flow of treatment solution 50. Thus they obstruct direct horizontal flow of the solution between the treatment and heat transfer zones. Both the longitudinal walls 32 and transverse walls 34 have cutouts 40 at their tops and bottoms to facilitate the flow of treatment solution over and under these walls. Thus, the horizontal flow obstructing portions of the walls are those portions between the top and bottom cutouts and horizontal flow above and below those portions are provided for.

Each treatment zone 80 has a parts support rack 42 disposed therein for holding parts in a predetermined vertical position within the treatment zone during treatment. These parts racks are preferably supported by the transverse walls 34 and comprised of a plurality of strips 43 disposed parallel to the transverse walls 34. These strips 43 preferably have knife-like edges at their upper and lower extremities in order to minimize the collection, trapping or retention of stagnant treatment solution, precipitates or gas bubbles at these locations.

The tank partitioner 30 is immersed in and is preferably completely submerged with the treatment solution 50 as is indicated by the dashed line 48 along the walls of the tank indicating the level of the top of the partitioner 30.

The solid portions of the partitioner walls 32 and 34 isolate the treatment and heat transfer zones from each other and serve as baffles to control the path along which the treatment solution 50 can flow from the treatment zone 80 to the heat transfer zone 90 and vice versa. Direct flow of the solution between the treatment zone and the heat transfer zone is prevented by the solid portions of the walls. However, indirect solution flow between these two zones is made possible by the cutouts 40 which allow the solution to flow over and under the solid portions of the walls.

The tank partitioning or compartmentalizing means 30 preferably is fabricated as an insert to be inserted in an otherwise unobstructed treatment tank. This insert comprises the solid walls forming the treatment chambers and means such as legs or the cutouts 40 for positioning the solid chamber walls above the bottom of the tank to allow solution to flow under the walls in a substantially unobstructed manner. The insert preferably comprises both the chamber walls and heat transfer tube supports and the tubes. However, the tube support and the chamber walls may be separate or other heat removal means may be used. Other techniques then the parts racks 42 may be utilized, such as shoulders on the chamber walls to support parts holders.

The tank 12 and the partitioner 30 including the parts racks 42 are preferably made from rigid PVC which contains no plasticizers. This is for maximum durability in the presence of acidic treatment solutions. Although the fabrication of the partitioner from flat plates is preferred, other techniques such as molding may be utilized if desired.

It is preferred that a separate set of two heat transfer tubes 38 encircle each treatment zone 80 in a spiraled, layered figuration in order to provide a large heat transfer area for exposure to the treatment solution. It is preferred that each tube having two turns around the treatment zone in each layer of the tube configuration.

The flow of heat transfer fluid through all four of the cooling tubes 38 is controlled by a single flow control valve 74 (FIG. 3) in response to a temperature sensor 72 which is immersed in the treatment solution 50. It is preferred to utilize a mechanical temperature control system such as a model MCC Powers Fiat number 11 regulator temperature controller manufactured by MCC Powers, Skokie, Illinois which employs gas pressure on a mechanical diaphragm to control the flow control valve. This is preferred because such a system is extremely reliable (which minimizes downtime), is relatively inexpensive and has been found to do a satisfactory job.

The heat transfer fluid is preferably cooling water which may either be recirculated through a chiller or disposed of in a drain following its circuit through the heat transfer tubes 38.

The heat transfer tubing is preferably linear polyethylene tubing having an inner diameter of about 0.210 inch (0.53 cm) and an outer diameter of about 0.250 inch (0.64 cm). In a tank 18 inches (45.7 cm) long in the direction parallel to the longitudinal walls 32 and 15 inches (38.1 cm) long in the direction parallel to the transverse walls 34 and 18 inches (45.7 cm) deep and having two treatment zones each 4 inches (10.16 cm) by 10 inches (25.4 cm) by 13 inches (33 cm) tall, four tubes each having a length of about 150 feet (45.7 m) has been found satisfactory for controlling the temperature of an etching treatment solution.

The specified tubing allows sufficient water flow through the length of this tubing and provides sufficient thermal conductivity through the thickness of the tubing to provide the desired degree of control over the temperature of the treatment solution.

In nitric acid/hydrofluoric acid ($HNO_3$/HF) solutions tubing containing plasticizers embrittles due to leaching of the plasticizers. The resulting brittle tubing is easily broken which reduces system reliability. The specified linear polyethylene tubing is preferred because it contains no plasticizers and therefore does not embrittle in these solutions.

Figure 3:
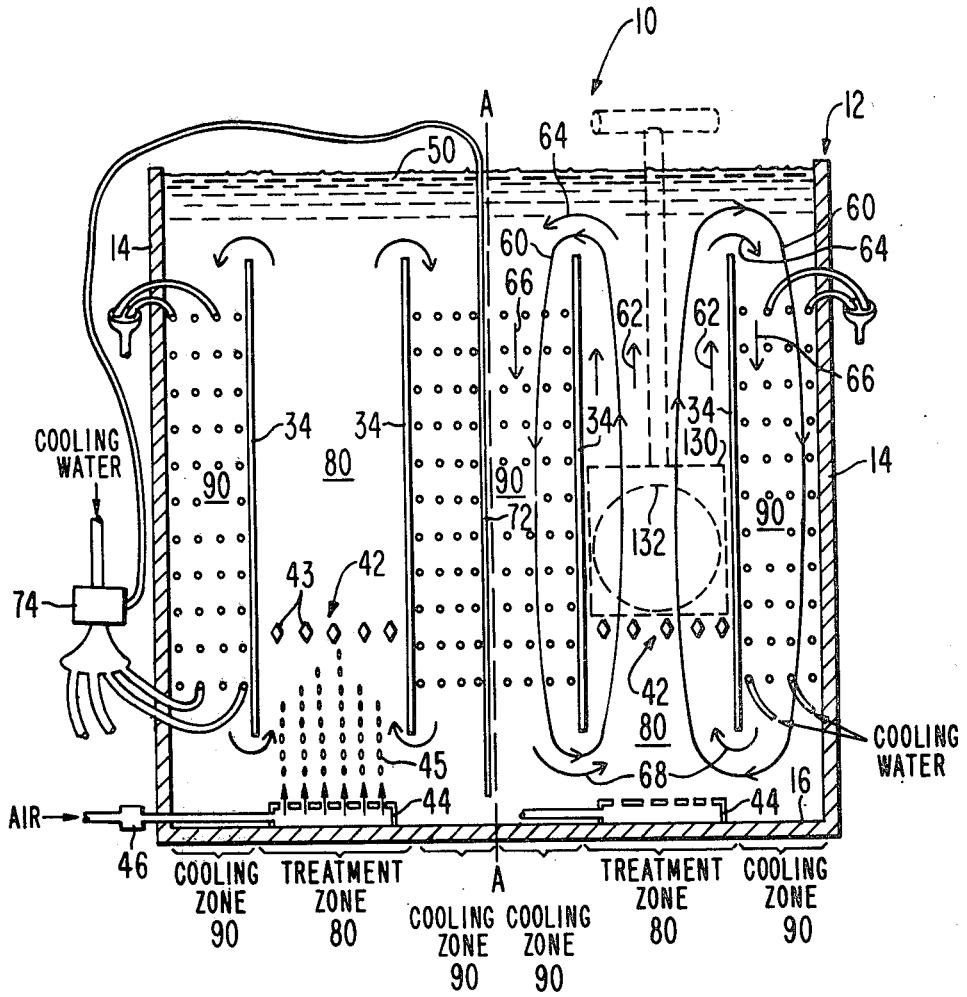
FIG. 3 is a vertical cross-section of the tank in FIG. 2.

A gas block 44 is disposed within the tank beneath each treatment zone 80. These gas blocks are connected to a source of pressurized gas through a flow control valve 46 (FIG. 3). When the valve 46 is opened the gas block releases many streams of small bubbles 45 (left-hand portion of FIG. 3) into the treatment solution. Air may be used as the gas if desired, however if this induces undesired chemical reactions then an inert gas should be used instead. Preferably the gas blocks are hollow and have about 85 discrete holes in the upper surface of each. Porous, acid resistant material may be used in place of the discrete holes if desired. In FIG. 3 the air tubing and heat transfer tubing are shown passing through the tank walls 14. In the actual system it is preferred to have all of these tubes enter the tank through its open top without creating any apertures in the tank walls which can result in leaks and reduce reliability. Further, this simplifies tank construction.

OPERATION

The two treatment zones or chambers are illustrated under different conditions in FIG. 3.

The left hand chamber illustrates the conditions existing when it is desired (1) to mix newly formed treatment solution, (2) to circulate the solution to obtain a desired initial temperature or (3) to stir the solution after a period of non-use such as a coffee or lunch break. The gas block under this treatment zone is illustrated as though the valve 46 were open and streams of bubbles 45 were eminating from the bubbler. In the manner which is well known in fish aquarium filter systems, these bubbles induce circulation of the treatment solution upward through the treatment zone 80, over the top of the treatment chamber walls 32 and 34, down through the temperature adjustment zone 90 under the walls and up through the treatment chamber. In this way thorough stirring of the treatment solution is obtained with the only energy consumption being that needed to provide the compressed air or other gas which flows from the gas block 44. After a coffee or lunch break, it is preferred to run the gas bubblers for one or two minutes before treating parts in order to assure solution uniformity at the beginning of the treatment. In order to mix newly formed solution it is preferred to run the gas bubblers for from five to ten minutes. If the treatment solution 50 is at a temperature below that desired for the treatment reaction, a hot heat transfer fluid can be passed through the tubes 38 during this stirring interval in order to bring the solution to the desired reaction temperature prior to immersing parts in the treatment solution. If desired, this can be done by providing a three-way temperature controlled valve in series with the tubing 38 with connections to both hot and cold heat transfer fluids, by other automatic techniques or by manually opening a valve to permit hot heat transfer fluid to flow through the tubing until the solution reaches the desired temperature.

The right hand treatment zone in FIG. 3 is illustrated in the condition which preferably exists when parts such as semiconductor wafers are being treated in that zone. Under these conditions the compressed gas control valve 46 is off and *no* gas bubbles are escaping into the treatment solution from the gas block 44 under the treatment zone. This is for two reasons. First, the presence of gas bubbles results in bubble tracks on the treated wafers which is considered detrimental and second, mechanical stirring is unnecessary to assure uniform solution composition and temperature.

A parts rack 130 containing wafers 132 (both illustrated in phantom) is illustrated disposed on the parts support rack 42 in this treatment zone. The wafers 132 or material thereon reacts exothermically with the treatment solution 50. This heats the solution within this treatment zone. This heated treatment solution expands and tends to rise within the treatment zone 80 as indicated by the arrows 62. This is a normal convective effect. Since the chamber walls 32 and 34 are substantially impervious to the flow of the treatment solution, this vertical movement of the heated treatment solution forces the solution thereabove to flow upward and outward over the top of the chamber walls and into the heat transfer zone 90 as indicated by the arrows 64. This in turn causes treatment solution to flow down through the temperature adjustment zone 90 (as indicated by arrows 66) where it is subject to cooling when cooling fluid is flowing through the tubes 38. Cool solution from this heat transfer zone flows downward and under the bottom of the treatment chamber walls (as indicated by the arrows 68) under the influence of gravity since it is denser than the heated solution within the treatment zone. This cool treatment solution than flows upward through the treatment zone as indicated by arrows 62 in response to the continued upward movement of the heated solution thereabove and as a result of its own expansion as it is heated by its reaction with the wafers. This type of circulation occurs about each of the treatment chamber walls 32 and 34. The flow of hot solution over the top of the walls is substantially isolated from the flow of cold solution under the walls by the vertical separation between these flows and the density difference between the hot and cold solution.

The treatment solution flowing into the bottom of the treatment zone 80 is cooler than the now heated solution within the treatment zone, either because it was cooler to begin with (at the beginning of the treatment cycle) or has been cooled in its passage from the top of the heat transfer zone down past the tubes 38 to the bottom of the heat transfer zone (during the treatment of parts following the initial period and for a short period after completion of the treatment cycle). This solution flow constitutes macroconvection of large scale convection in which the solution flows or circulates in a long path with a minimum of back waters and eddies. This path is illustrated by the arrows 60. This macroconvective flow of the treatment solution provides substantially uniform cooling of the solution, aids in maintaining uniform solution composition and assures even treatment of all wafers.

In order that the greatest efficiency in the macroconvective flow may be maintained, it is preferred to have each treatment zone centered within its associated heat transfer zone with respect to horizontal displacements. It is also preferred to have the cross-sectional area of a treatment zone substantially equal to the cross-sectional area of its associated heat transfer zone, taking into account the area occupied by the heat transfer tubing in order that there will be substantially equal areas open for treatment solution flow. It is similarly desirably to have the area within the treatment solution which is available for solution flow over and under the treatment chamber walls be at least as great as the cross-sectional area of the treatment zone in order that unobstructed treatment solution flow may take place.

In order to minimize the quantity of material used in constructing the equipment and the amount of solution used to fill the tank, it is preferred that the cross-sectional areas of the treatment and heat transfer zones not vary by more than about a factor of 3 from the cross-sectional areas over and under the walls. An excessively small cross-sectional area in any location through which the macroconvective flow must pass would result in unnecessary and undesirable restriction of this macroconvective flow. However, a substantial increase in one of these areas or all of them can be tolerated.

In the treatment chambers of the preferred tank, a wafer basket containing thirty-nine 2 inch (5.08 cm) or 2¼ inch (5.72 cm) wafers in a single level can be inserted in each treatment zone. A similar basket containing a single row of 3 inch (7.62 cm) wafers can be used for the treatment of twenty-five wafers at a time in each treatment zone.

Using the specified system the temperature of the treatment solution is easily held at 33° C.±3° C. with a cooling water temperature of from 5° C. to 26° C. (this is the seasonal variation in the temperature of incoming water). No cooling water flows when the solution temperature is below 30° C. and maximum cooling water flows if the solution reaches 36° C. The ±3° C. range is a result of the employment of the above specified temperature control to control water flow. Manual adjustment of the cooling water valve while observing a thermometer immersed in the treatments solution can be used to maintain the temperature within ±1° C. of the desired 33° C. Consequently, tighter automatic control can be obtained if the need justifies the cost of a system providing that degree of control.

If the treatment solution has one or more components which need to be replenished at frequent intervals or continuously this can be done on a continuing or automatic basis. One way of doing this where very small additions are needed is to extract treatment solution from a corner of the tank using a circulating pump and bleed the additions into this extracted solution and return the replenished solution to the tank via the gas block which will assure its even distribution throughout the treatment zone.

The use of the circulating pump may be avoided if the addition rate is such that the added material can adequately mix by direct addition to the solution in the tank. Similarly, additions can be made between the treatment of successive batches of wafers and the solution stirred using the gas blocks.

An etching tank which uses natural convection to cool and stir processing solutions has been shown and described. Non-compartmentalized tanks of the illustrated configuration are commercially available. This system is simple to construct because the other parts are either straight forward to fabricate (insert 30) or commercially available (flow controller for heat transfer fluid). As a result, initial capital costs are minimized as is any downtime for replacement of any parts which may need to be replaced. Although in the preferred embodiment two treatment zones were situated within one tank, any number of treatment zones may be utilized in accordance with the size of the tank selected and the parts racks used to hold parts to be treated. The multizone tank has at least two zones—one treatment zone and one cooling zone.

This system achieves efficient, economical operation without the need for external application of energy except to initially mix the treatment solution, to bring it to temperature initially, to stir it following a period of non-use and for supplying cooling fluid. During periods of continual use only cooling needs to be supplied externally. Those skilled in the art will be able to modify the details of this preferred embodiment without departing from the scope of the invention as defined in the appended claims.

What is claimed is:

1. Apparatus for the treatment of parts in a solution with which the parts have an exothermic reaction, said apparatus comprising:

a tank having a bottom and side wall means having a bottom edge adjacent said bottom and a top edge spaced therefrom to define a volume in which the solution can be contained;

partition wall means in said tank, said partition wall means extending from adjacent said bottom to adjacent said top edge of said side wall means and surrounding a treatment zone in which the parts to be treated can be contained, said partition wall means being spaced from said side wall means and forming a heat transfer zone surrounding said treatment zone, communication means between said treatment zone and said heat transfer zone, said communication means being formed in said partition wall means adjacent said bottom and adjacent said top edge of said side wall means, whereby the heated solution in said treatment zone flows through said communication means adjacent said top edge of said side wall means to said heat transfer zone, and cooling means in said heat transfer zone for cooling the heated solution whereby the cooled solution flows through said communication means adjacent said bottom to said treatment zone.

2. Apparatus in accordance with claim 1 including a gas block for circulating the solution when no parts are being treated.

3. Apparatus in accordance with claim 1 wherein said communication means comprises notches in said partition wall means.

4. Apparatus in accordance with claim 1 wherein the cross-sectional area of said treatment zone is substantially equal to the cross-sectional area of said heat transfer zone.

5. Apparatus in accordance with claim 1 or 4 wherein said partition wall means surrounds a plurality of treatment zones, said treatment zones being separated from each other by a heat transfer zone.

6. Apparatus in accordance with claim 1 wherein said cooling means includes tubes spiraled around said treatment zone in said heat transfer zone, said tubes being connected to a source of coolant.

* * * * *